US009468324B1

(12) United States Patent
DeJohn

(10) Patent No.: US 9,468,324 B1
(45) Date of Patent: Oct. 18, 2016

(54) SPACE SAVING PLATE WITH AN INTEGRATED NAPKIN DISPENSER

(71) Applicant: Gerald DeJohn, High Point, NC (US)

(72) Inventor: Gerald DeJohn, High Point, NC (US)

( * ) Notice: Subject to any disclaimer, the term of this patent is extended or adjusted under 35 U.S.C. 154(b) by 0 days.

(21) Appl. No.: 15/099,861

(22) Filed: Apr. 15, 2016

Related U.S. Application Data

(60) Provisional application No. 62/192,239, filed on Jul. 14, 2015.

(51) Int. Cl.

| | |
|---|---|
| ***A47B 37/00*** | (2006.01) |
| ***A47G 23/08*** | (2006.01) |
| ***A47K 10/42*** | (2006.01) |
| ***A47G 19/08*** | (2006.01) |

(52) U.S. Cl.
CPC ..... *A47G 23/08* (2013.01); *A47G 19/08* (2013.01); *A47K 10/426* (2013.01)

(58) Field of Classification Search
CPC .... A47G 23/08; A47G 19/08; A47K 10/426; A47B 96/02; A47B 96/022; A47B 96/16; A47B 83/00; A47B 37/00; A47B 45/00; A47B 11/00; A47B 2200/02
USPC ..... 108/42, 90, 94, 95, 96, 50.11; 221/33, 221/44
See application file for complete search history.

(56) References Cited

U.S. PATENT DOCUMENTS

| | | | | | |
|---|---|---|---|---|---|
| 184,362 | A * | 11/1876 | Fischer | A47B 11/00 | 108/20 |
| 432,356 | A * | 7/1890 | Beck | A47B 11/00 | 108/94 |
| 556,566 | A * | 3/1896 | Stevens | A47B 1/056 | 108/66 |
| 1,360,856 | A * | 11/1920 | Zander | A47F 5/025 | 108/20 |
| 2,063,581 | A * | 12/1936 | Campbell | A24F 19/0071 | 108/101 |
| 3,170,416 | A * | 2/1965 | Gerlich | A47J 37/0878 | 108/14 |
| 3,659,535 | A * | 5/1972 | Cerney | B65G 1/07 | 108/136 |
| 3,930,701 | A * | 1/1976 | Otakie | A47B 81/06 | 108/28 |
| 4,227,467 | A * | 10/1980 | Kindsfather | A47G 23/06 | 108/101 |
| 4,295,680 | A * | 10/1981 | Grasso | A01K 97/22 | 190/11 |
| 4,379,587 | A * | 4/1983 | Duncan | A01K 97/01 | 297/130 |
| 4,895,418 | A * | 1/1990 | Medellin | B67D 1/06 | 108/38 |
| 5,322,171 | A * | 6/1994 | Pingelton | B65G 1/07 | 108/136 |
| 6,148,737 | A * | 11/2000 | Bowman | B67D 3/00 | 108/42 |
| 6,273,005 | B1 * | 8/2001 | Wehrmeyer | A47K 17/00 | 108/42 |
| 6,349,657 | B1 * | 2/2002 | Wohlford | A47B 81/065 | 108/94 |
| 6,827,028 | B1 * | 12/2004 | Callaway | A47B 3/06 | 108/157.1 |
| 7,059,253 | B2 * | 6/2006 | Cho | A47B 83/045 | 108/43 |
| 7,290,490 | B2 * | 11/2007 | Goldberg | A47B 23/001 | 108/24 |
| 2003/0062375 | A1 * | 4/2003 | Christensen | A47K 10/424 | 221/46 |
| 2013/0087083 | A1 * | 4/2013 | Martinez | A47B 96/02 | 108/42 |

* cited by examiner

*Primary Examiner* — Jose V Chen

(57) ABSTRACT

A space saving plate with an integrated napkin dispenser which allows a multitude of patrons to easily share food items at a table. The apparatus includes a napkin dispenser, a holding platform, and a rotation mechanism. The napkin dispenser retains and provides easy access to napkins. The holding platform is a flat vessel, which supports food items, dishes, and other devices that may contain food items. The holding platform is positioned parallel and adjacent to a top surface of the napkin dispenser. The rotation mechanism comprises a stator and rotor, and is positioned in between the napkin dispenser and the holding platform. The stator is adjacently connected to the top surface. The rotor is adjacently connected to the holding platform. The holding platform is concentrically aligned with a rotation axis of the rotation mechanism. The rotor is rotatably engaged to the stator to allow the holding platform to rotate.

15 Claims, 5 Drawing Sheets

SPACE SAVING PLATE WITH AN INTEGRATED NAPKIN DISPENSER

The current application claims a priority to the U.S. Provisional Patent application Ser. No. 62/192,239 filed on Jul. 14, 2015.

FIELD OF THE INVENTION

The present invention relates generally to accessories for use on a dinner table. More specifically, the present invention is a rotatable food holding platform that is connected to a napkin dispenser. The present invention is designed to uplift trays of food, so as not to encumber mobility of patrons eating at the dinner table.

BACKGROUND OF THE INVENTION

When multiple people are eating at the same table, it can be difficult to consistently access sharable food items such as pizza, hors d'oeuvres, etc. Such foods are most often times brought on a hot tray. The hot tray is typically put in one place on the table, taking up a large amount of space and reducing the amount of space left for plates, silverware, condiments and napkins. Many times, the tray can only be accessed by one person who is forced to act as a server. This situation can be inconvenient, especially for those who are extremely hungry and those who don't feel comfortable with others handling their food. There is little to no space left for any extra items. There exists a need for a device that can better organize table accessories by providing an elevated support adaptor to support a pizza pan or other suitable device thereon. Currently, there are support devices which provide an elevated rotatable stand. These devices, however, fail to include a napkin dispenser with a rotatable, upper surface plate sized for supporting a tray thereon. Such features, however, are provided by the presented invention. With food kept out of the way and able to be conveniently accessed, extensive table space can be saved for other items such as salt, pepper, plates, and other table accessories. Patrons may also obtain napkins at any time, without asking for assistance from others or the server. When no food is ordered requiring a large tray, the space saving platform can be kept in the kitchen so as not to confuse dining patrons.

DETAIL DESCRIPTIONS OF THE INVENTION

All illustrations of the drawings are for the purpose of describing selected versions of the present invention and are not intended to limit the scope of the present invention.

The present invention relates generally to table accessories. More specifically, the present invention is a platform for holding/supporting food items at a table with an integrated napkin dispenser 1. The present invention provides each patron at the table easy access to the food items while simultaneously increasing available table space for plates and other table accessories. This is achieved by raising the surface which holds/supports the food items and integrating a napkin dispenser 1 directly underneath said surface.

Figure 1:
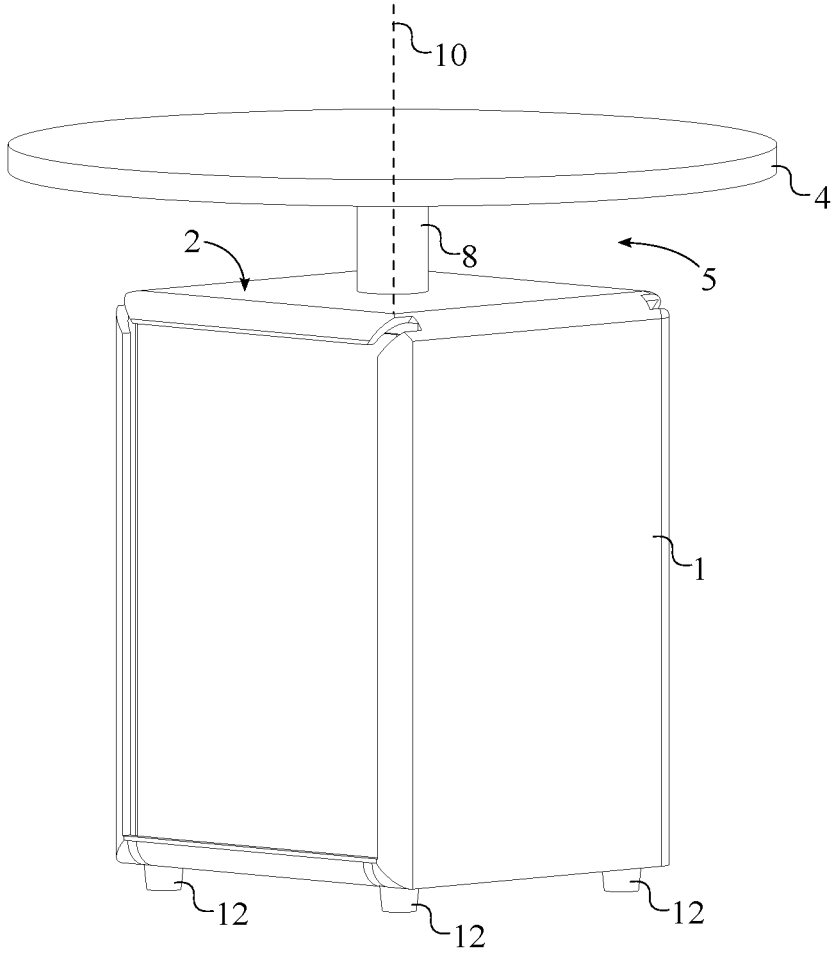
FIG. 1 is a perspective view of the present invention.

Referring to FIG. 1, the present invention comprises the napkin dispenser 1, a holding platform 4, a rotation mechanism 5. The holding platform 4 is a flat vessel, which supports food items, dishes, pizza pans, utensils, plates, and other devices that may contain food items. The preferred holding platform 4 is a disk, although alternative shapes and designs may be utilized instead. Additionally, referring to FIG. 5, a diameter 14 of the holding platform 4 is preferably eight inches, although alternative sizing may also be used. The napkin dispenser 1 holds, stores, and distributes napkins. A variety of designs of napkin dispensers 1 may be used for the present invention, although a symmetric shape is preferred to prevent precession and to promote stability of the present invention. Additionally, the napkin dispenser 1 is the structure which supports and elevates the holding platform 4 in order to free up table space. The holding platform 4 is positioned parallel and adjacent to a top surface 2 of the napkin dispenser 1.

Figure 3:
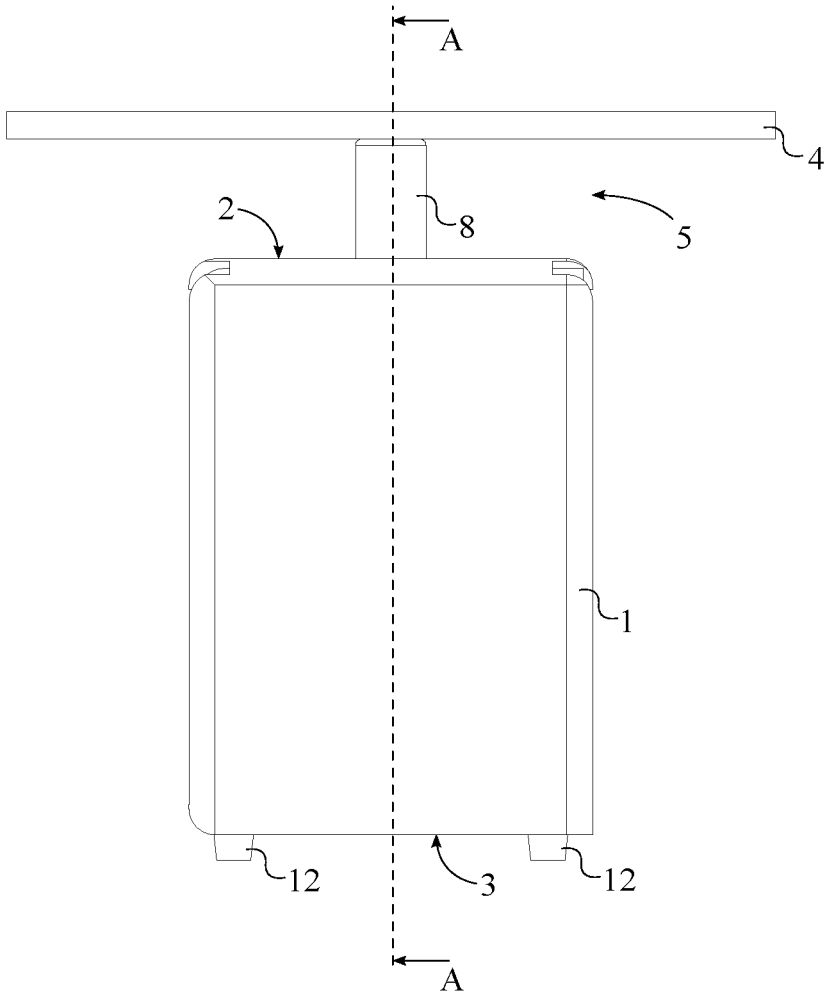
FIG. 3 is a right-side view of the present invention.
Figure 5:
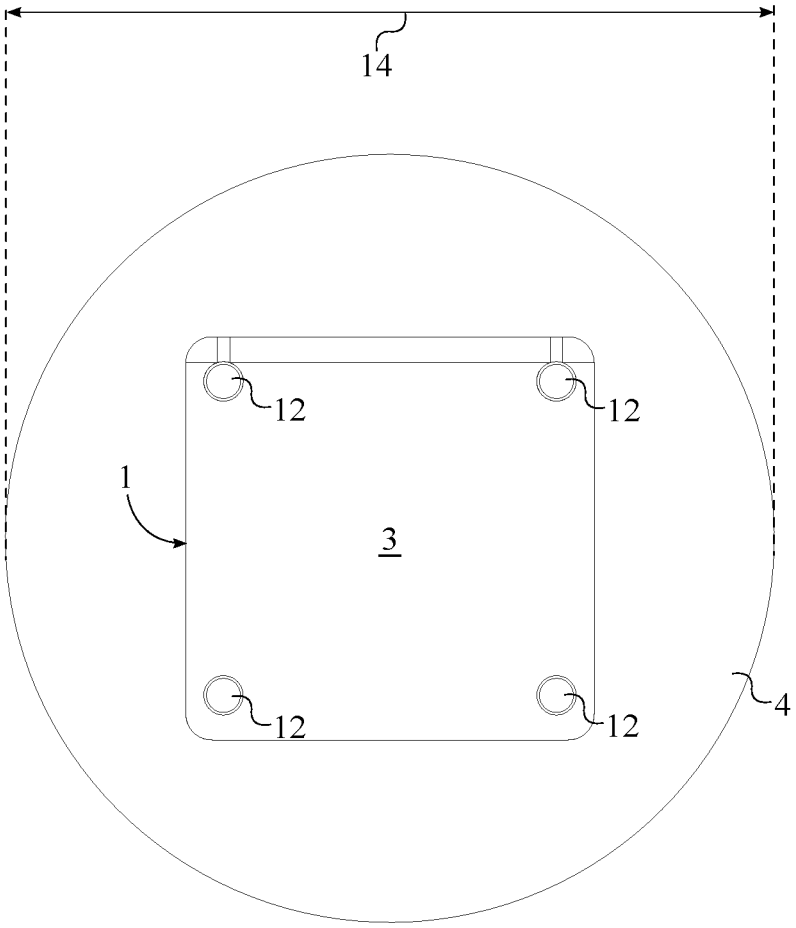
FIG. 5 is a bottom view of the present invention.

The rotation mechanism 5 mechanically couples the holding platform 4 to the napkin dispenser 1 and allows the holding platform 4 to rotate relative to the napkin dispenser 1. Referring to FIG. 3, the rotation mechanism 5 is positioned in between the napkin dispenser 1 and the holding platform 4, and comprises a rotor 6 and a stator 8. The stator 8 is the stationary element of the rotation mechanism 5 and is adjacently connected to the top surface 2. The rotor 6 is the rotating element of the rotation mechanism 5 and is adjacently connected to the holding platform 4. The rotor 6 is rotatably engaged to the stator 8 along a rotation axis 10, wherein a rotation axis 10 of the rotation mechanism 5 and is oriented normal to the top surface 2. The holding platform 4 is concentrically aligned with the rotation axis 10 as seen in FIG. 5. This ensures that the holding platform 4 rotates about the rotation axis 10, increasing the stability of the present invention.

Figure 2:
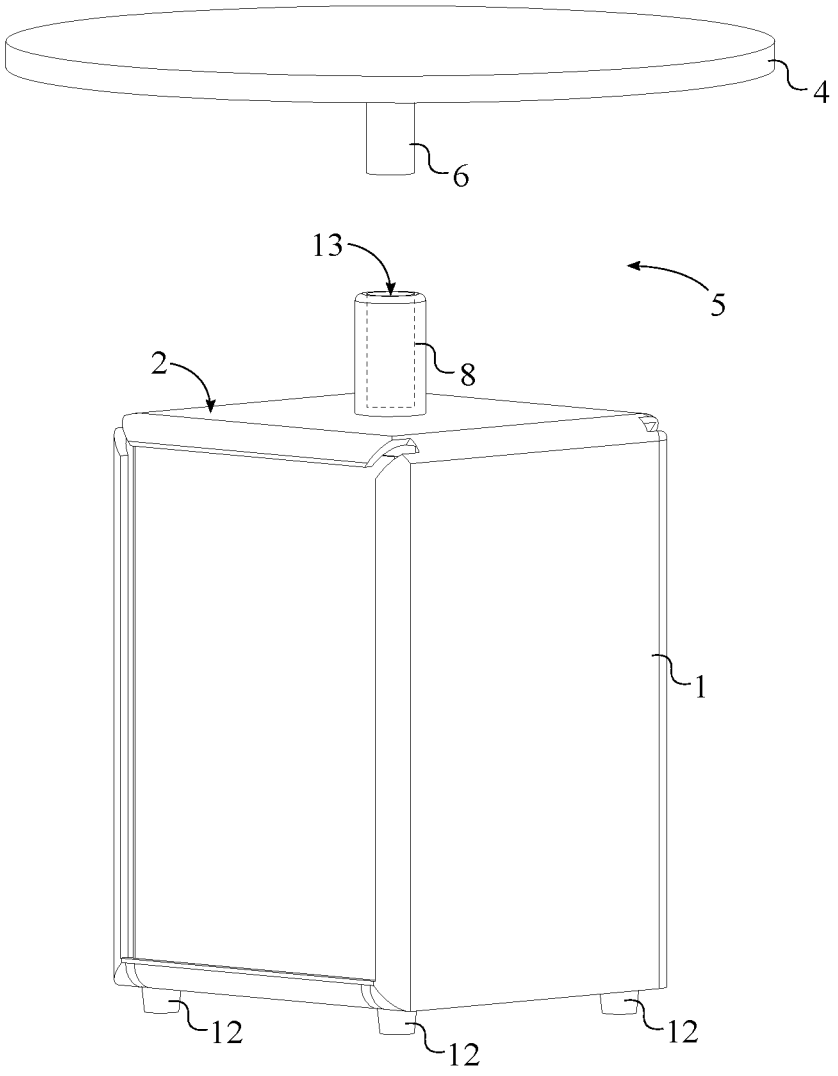
FIG. 2 is an exploded perspective view of the present invention, wherein the rotor is a shaft and the stator is a tubular support.
Figure 4:
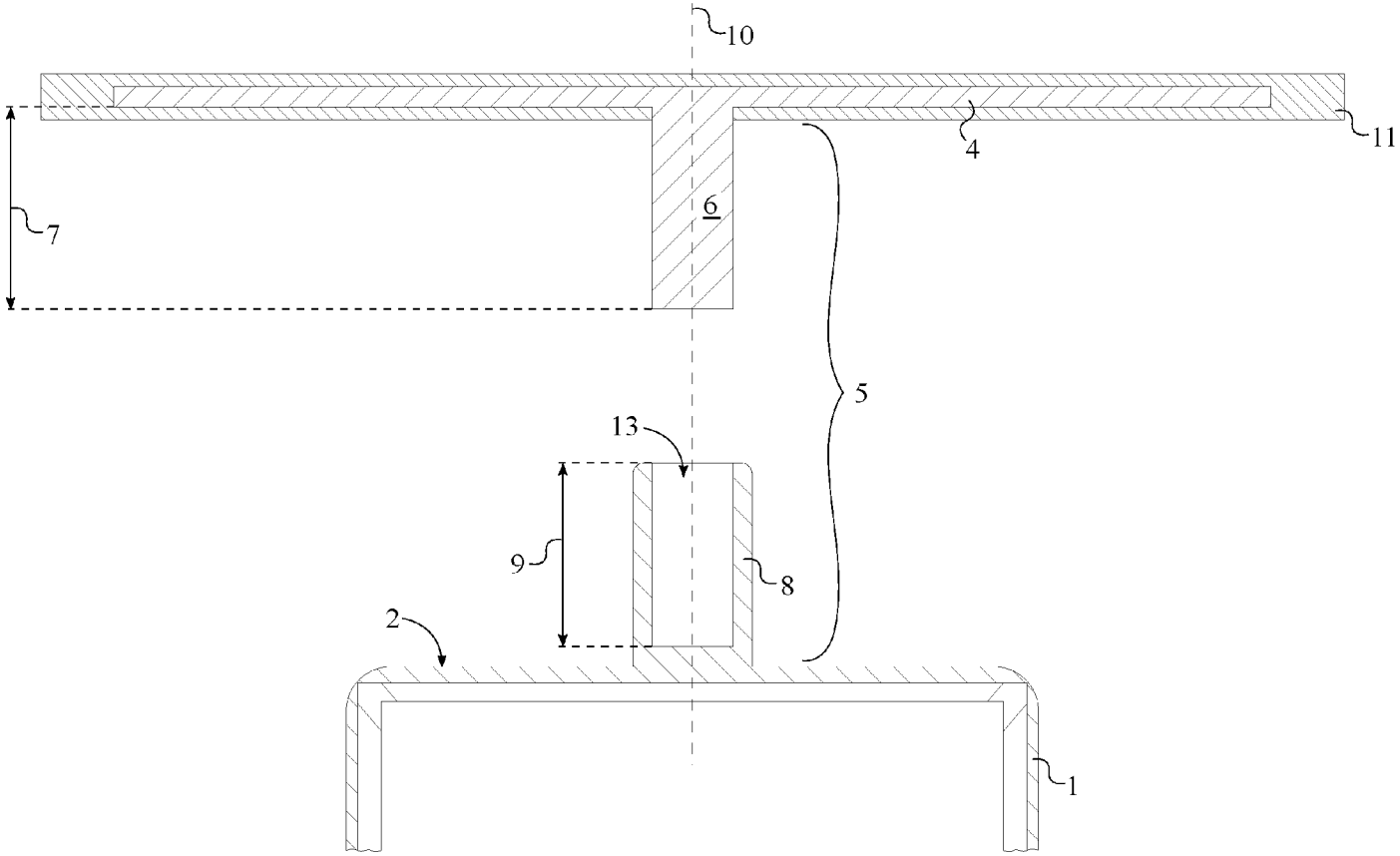
FIG. 4 is a cross-sectional view taken about line A-A in FIG. 3, wherein the rotor is a shaft and the stator is a tubular support.

Referring to FIG. 2 and FIG. 4, the preferred rotation mechanism 5 comprises a tubular support and a shaft, wherein the tubular support is the stator 8 and the shaft is the rotor 6. The tubular support is an elongated pipe-like structure that is sized to receive the shaft. The tubular support is oriented normal to the top surface 2. Additionally, the tubular support is concentrically positioned with the top surface 2 to ensure vertical stability. Vertical stability is essential in cases when food items are placed on the holding platform 4 in an asymmetric fashion, thus potentially tipping the present invention on its side. The shaft is an elongated cylinder that is oriented normal to the holding platform 4.

The shaft is rotatably and removably engaged into a shaft-receiving cavity 13 of the tubular support, allowing the shaft to rotate relative to the tubular support. Resultantly, the holding platform 4 is free to rotate relative to the napkin dispenser 1, about the rotation axis 10 of the rotation mechanism 5. Additionally, the rotation mechanism 5 provides an easy and quick means for separating the holding platform 4 from the napkin dispenser 1, ideal for cleaning and storage purposes. Furthermore, a length 7 of the shaft is preferably greater than a length 9 of the shaft-receiving cavity 13 as seen in FIG. 5. This ensures the that a top end of the tubular support does not touch a bottom surface of the holding platform 4 as this can increase frictional forces, wear and tear, and decrease the ease with which the holding platform 4 rotates. In general, the rotation mechanism 5 allows any patron at the table to rotate the holding platform 4 in order to position any food item on the holding platform 4 closer to him/her without external aid, i.e. other patrons at the table or the server. In alternative embodiments, the present invention may utilize alternative devices and mechanisms as the rotation mechanism 5.

Referring to FIG. 4, the present invention further comprises a grip enhancing coating 11. The grip enhancing coating 11 is a slip-resistant layer for the holding platform 4 to ensure food items, dishes, and trays do not easily translate on the holding platform 4. The grip enhancing coating 11 is superimposed over the holding platform 4. The grip enhancing coating 11 covers all the exposed surfaces of the holding platform 4, above and below, and is characterized by having a relatively high coefficient of friction. This prevents the food items from slipping on the top of the holding platform 4. It is important to cover the bottom surface of the holding platform 4 as this is what the patrons touch to rotate the holding platform 4. In one embodiment, the grip enhancing coating 11 is composed of heat-resistant matter to serve as an insulating layer. The heat-resistant matter prevents warm food items from heating up the holding platform 4, thus allowing patrons to touch and rotate the holding platform 4 without getting burned. In the preferred embodiment of the present invention, the grip enhancing coating 11 is composed of silicone matter. Silicone matter is the ideal composition because it is slip-resistant and a significant thermal insulator. Additional coating and layers may be used in conjunction and/or instead of the grip enhancing coating 11 to further decrease the chances of injury while using the present invention.

Referring to FIG. 3 and FIG. 5, the present invention further comprises a plurality of legs 12. The plurality of legs 12 raises and supports the napkin dispenser 1. More specifically. The plurality of legs 12 is adjacently positioned to the napkin dispenser 1, opposite the rotation mechanism 5. Each of the plurality of legs 12 is adjacently and normally connected to a bottom surface 3 of the housing. Furthermore, it is preferred that the plurality of legs 12 is radially distributed around the bottom surface 3 for increased stability. Referring to FIG. 5, the plurality of legs 12 comprises four legs that are distributed about the four different corners of the housing for maximum stability. In another embodiment of the present invention, a weighted base may be attached to the bottom surface 3 of the napkin dispenser 1. The weighted base acts as an anchor for the present invention in order to prevent accidental tipping.

A variety of different designs may be used for the napkin dispenser 1. In the preferred embodiment, the napkin dispenser 1 comprises a housing and an at least one pushing mechanism. The housing is brick-shaped structure with a central cavity that is sized to receive the standard napkin. The pushing mechanism is internally integrated into the central cavity and applies a force for the napkins inside the housing. This positions the napkins towards an opening of the central cavity where patrons at the table may easily access and obtain.

Although the invention has been explained in relation to its preferred embodiment, it is to be understood that many other possible modifications and variations can be made without departing from the spirit and scope of the invention as hereinafter claimed.

What is claimed is:

1. A space saving plate with an integrated napkin dispenser comprises:
- a napkin dispenser;
- a holding platform;
- a rotation mechanism;
- a grip enhancing coating;
- the rotation mechanism comprises a rotor and a stator;
- the holding platform being positioned parallel and adjacent to a top surface of the napkin dispenser, the holding platform having a flat lower surface, the flat lower surface being positioned parallel and adjacent to the top surface;
- the rotation mechanism being positioned in between the top surface of the napkin dispenser and the flat lower surface of the holding platform;
- the stator being mounted on the top surface;
- a rotation axis of the rotation mechanism being oriented normal to the top surface;
- the holding platform being concentrically aligned with the rotation axis of the rotation mechanism;
- the rotor being mounted on the flat lower surface;
- the rotor being rotatably engaged to the stator along the rotation axis; and
- the grip enhancing coating being superimposed over the holding platform.

2. The space saving plate with the integrated napkin dispenser as claimed in claim 1, wherein the grip enhancing coating is composed of silicone matter.

3. The space saving plate with the integrated napkin dispenser as claimed in claim 1, wherein the grip enhancing coating is composed of heat-resistant matter.

4. The space saving plate with the integrated napkin dispenser as claimed in claim 1, wherein the holding platform is a disk.

5. The space saving plate with the integrated napkin dispenser as claimed in claim 4, wherein a diameter of the holding platform is eight inches.

6. The space saving plate with the integrated napkin dispenser as claimed in claim 1 comprises:
- a plurality of legs;
- the plurality of legs being mounted on a bottom surface of the napkin dispenser, opposite to the top surface;
- the plurality of legs being radially distributed around the bottom surface of the napkin dispenser; and
- each of the plurality of legs being normally mounted on the bottom surface.

7. The space saving plate with the integrated napkin dispenser as claimed in claim 1 comprises:
- the stator being a tubular support;
- the rotor being a shaft;
- the tubular support being oriented normal to the top surface;
- the shaft being oriented normal to the holding platform;
- the tubular support being concentrically positioned with the top surface; and
- the shaft being rotatably and removably engaged into a shaft-receiving cavity of the tubular support.

8. The space saving plate with the integrated napkin dispenser as claimed in claim 7, wherein a length of the shaft being greater than a length of the shaft-receiving cavity.

9. A space saving plate with an integrated napkin dispenser comprises:
- a napkin dispenser;
- a holding platform;
- a rotation mechanism;
- a grip enhancing coating;
- the rotation mechanism comprises a rotor and a stator;
- the holding platform being positioned parallel and adjacent to a top surface of the napkin dispenser, the holding platform having a flat lower surface, the flat lower surface being positioned parallel and adjacent to the top surface;

the rotation mechanism being positioned in between the top surface of the napkin dispenser and the flat lower surface of the holding platform;

the stator being mounted on the top surface;

a rotation axis of the rotation mechanism being oriented normal to the top surface;

the holding platform being concentrically aligned with the rotation axis of the rotation mechanism;

the rotor being mounted on the flat lower surface;

the rotor being rotatably engaged to the stator along the rotation axis;

the grip enhancing coating being superimposed over the holding platform;

the stator being a tubular support;

the rotor being a shaft;

the tubular support being oriented normal to the top surface;

the shaft being oriented normal to the holding platform;

the tubular support being concentrically positioned with the top surface; and the shaft being rotatably and removably engaged into a shaft-receiving cavity of the tubular support.

10. The space saving plate with the integrated napkin dispenser as claimed in claim 9, wherein the grip enhancing coating is composed of silicone matter.

11. The space saving plate with the integrated napkin dispenser as claimed in claim 9, wherein the grip enhancing coating is composed of heat-resistant matter.

12. The space saving plate with the integrated napkin dispenser as claimed in claim 9, wherein the holding platform is a disk.

13. The space saving plate with the integrated napkin dispenser server as claimed in claim 12, wherein a diameter of the holding platform is eight inches.

14. The space saving plate with the integrated napkin dispenser as claimed in claim 9 comprises:

a plurality of legs;

the plurality of legs being mounted on a bottom surface of the napkin dispenser, opposite to the top surface;

the plurality of legs being radially distributed around a bottom surface of the napkin dispenser; and each of the plurality of legs being normally mounted on the bottom surface.

15. The space saving plate with the integrated napkin dispenser as claimed in claim 9, wherein a length of the shaft being greater than a length of the shaft-receiving cavity.

* * * * *